US007946434B1

(12) United States Patent
Greenspon

(10) Patent No.: US 7,946,434 B1
(45) Date of Patent: May 24, 2011

(54) COLLAPSIBLE CLOTHES RACK

(75) Inventor: Steve Greenspon, Berkeley, IL (US)

(73) Assignee: Honey-Can-Do International, LLC, Berkeley, IL (US)

( * ) Notice: Subject to any disclaimer, the term of this patent is extended or adjusted under 35 U.S.C. 154(b) by 13 days.

(21) Appl. No.: 12/621,687

(22) Filed: Nov. 19, 2009

(51) Int. Cl.
*A47F 7/00* (2006.01)

(52) U.S. Cl. ..... 211/85.3; 211/195; 211/204; 280/79.3

(58) Field of Classification Search ..... 211/85.3, 211/186, 204, 182, 195; 280/79.3, 79.11, 280/47.35, 639; 248/166, 440
See application file for complete search history.

(56) References Cited

U.S. PATENT DOCUMENTS

| | | | | |
|---|---|---|---|---|
| 2,985,316 | A * | 5/1961 | Ruhnke | 211/201 |
| 5,090,725 | A * | 2/1992 | Feldner | 280/651 |
| 5,560,502 | A * | 10/1996 | Hsiung | 211/195 |
| 5,617,962 | A | 4/1997 | Chen | |
| 6,488,160 | B2 | 12/2002 | Wang | |

* cited by examiner

*Primary Examiner* — Korie Chan
(74) *Attorney, Agent, or Firm* — Adam K. Sacharoff; Much Shelist

(57) ABSTRACT

The present invention relates to a folding collapsible clothes rack. The rack includes two fixed side frames and two retractable side frames pivotally connected separately to the two fixed side frames. A pair of reinforcing links are pivoted together and coupled between the fixed side frames. In addition, a cross hanger tube is secured between the two retractable side frames and is able to be removably attached from one of them. The rack may also include a plurality of pockets positioned about the retractable side frames.

10 Claims, 12 Drawing Sheets

COLLAPSIBLE CLOTHES RACK

FIELD OF THE INVENTION

The present invention relates to a clothes rack for hanging clothes and, more particularly, to a folding collapsible clothes rack.

BACKGROUND OF THE INVENTION

Conventional clothes racks for home use or for use in shops for exhibiting commercial products are commonly made of wooden slats, metal tubes, or plastic members. These conventional clothes racks require much storage space when not in use because they are not collapsible. There are also known detachable clothes racks/When not in use, a detachable clothes rack can be collapsed. However, when the parts of a detachable clothes rack are detached, they must be well kept. If one part of a detachable clothes rack is lost, the detachable clothes rack can no longer be set up again.

Even with the prior part patents and prior designs, improvements are warranted and required to provide for different designs and elements not shown, used, described, or implied in the prior art.

SUMMARY OF THE INVENTION

The present invention relates to a folding collapsible clothes rack. The rack includes two fixed side frames and two retractable side frames pivotally connected separately to the two fixed side frames. A pair of reinforcing links are pivoted together and coupled between the fixed side frames. In addition, a cross hanger tube is secured between the two retractable side frames and is able to be removably attached from one of them. The rack may also include a plurality of pockets positioned about the retractable side frames.

As further defined by an embodiment of the invention, the fixed side frames may be defined by having a first fixed side frame and a second fixed side frame. Each of the side frames comprise two upright parallel slotted members and have a first lower member cross bar transversely connected between a lower region defined by the two upright parallel slotted members. The retractable side frames may be defined by having a first retractable side frame and a second retractable side frame. Each of the retractable side frames comprise two upright parallel retracting members and have an upper member cross bar transversely connected between an upper region defined by the two upright parallel retracting members. The pivotal connection junctions would preferably be connecting each upright parallel slotted member to a upright parallel retracting member such that each one of the retractable side frames is pivotally connected to one of the fixed side frame. The two reinforcing links are pivoted together and coupled between the fixed side frames. The links each have a lower end coupled to the first lower member cross bar and have an upper end coupled to a second lower member cross bar transversely positioned between the two upright parallel slotted members. The second lower member cross bar has ends slideably engaged within slots defined along the two upright parallel slotted members. The cross hanger tube has one end secured to one of the upper member cross bar and has another end removably secured to the other upper member cross bar.

In another embodiment, the rack includes wheel frames secured to lower regions defined by the two fixed side frames. The wheel frames are further defined by having a bottom wheel-member frame transversely secured about the lower region defined by the two upright parallel slotted members and each bottom wheel-member frame further includes a pair of caster wheels.

In a further embodiment, the cross hanger tube is further defined by having a first hanger tube having a diameter sized to receive a second hanger tube, such that the second hanger tube is able to expand from and retract within the first hanger tube. The end of the second hanger tube is further provided with a hook to removably secure the end to the other upper member cross bar.

In yet another embodiment, each pivotal connection junction is defined to include a button hinge plate positioned on an outside of the slotted and retracting members and a hinge plate positioned on an inside of the slotted and retracting members. A spring pin having a button extending outwardly from one side of the spring pin is positioned within the retracting member and aligned such that the button is extending out of an opening and further extending out of an aperture defined on the button hinge plate. The hinge member extends from a lower region of the retracting member and includes a hinge opening sized to receive a hinge rivet which extends through aligned openings on both the button hinge plate and on the hinge plate. Therefore, when depressing the button through the button hinge plate, the retracting member is able to pivot about the hinge rivet.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
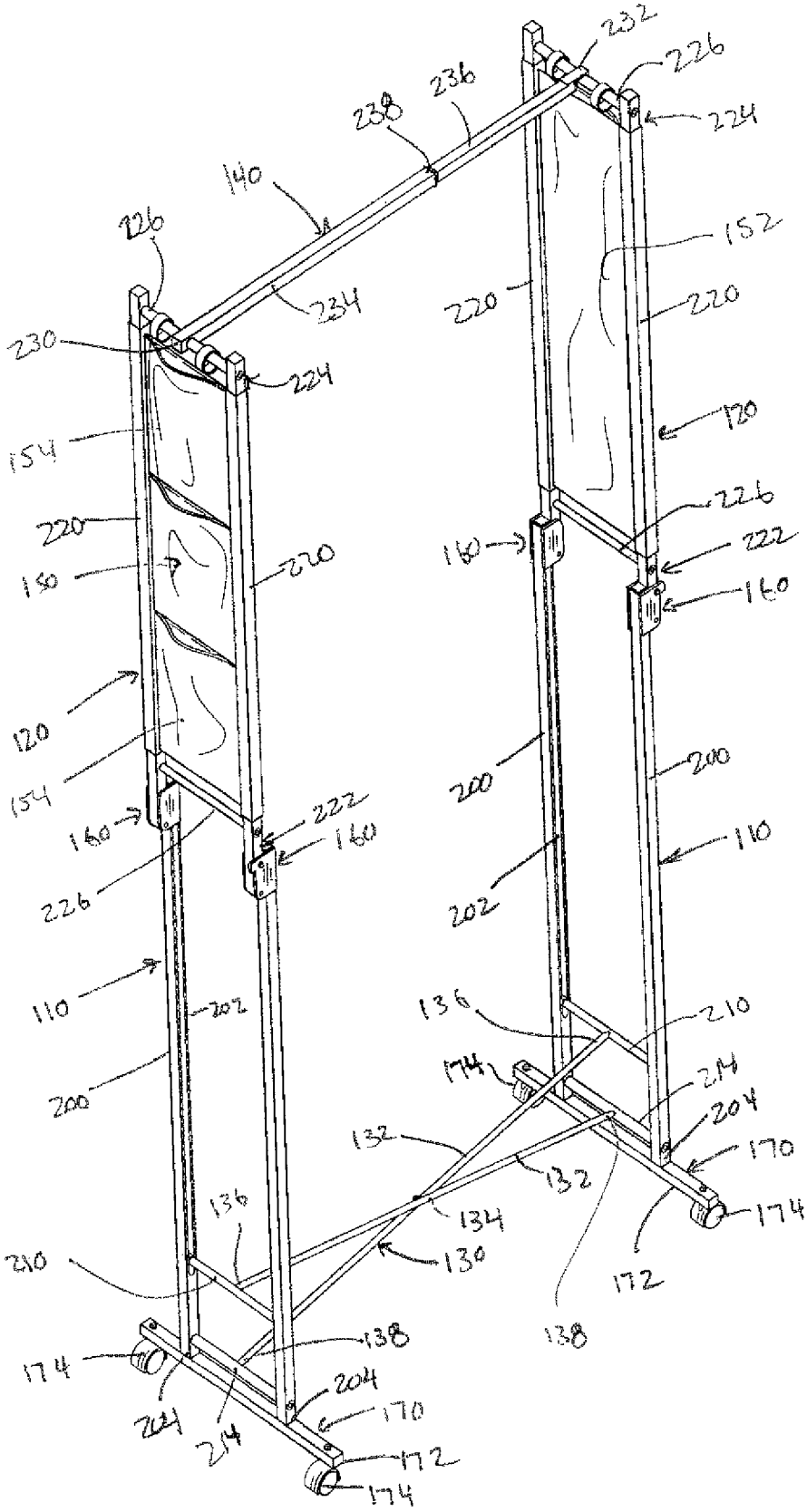
FIG. 1 is a perspective view of a folding collapsible clothes rack in accordance to an embodiment of the invention and shown in an unfolded position.
Figure 2:
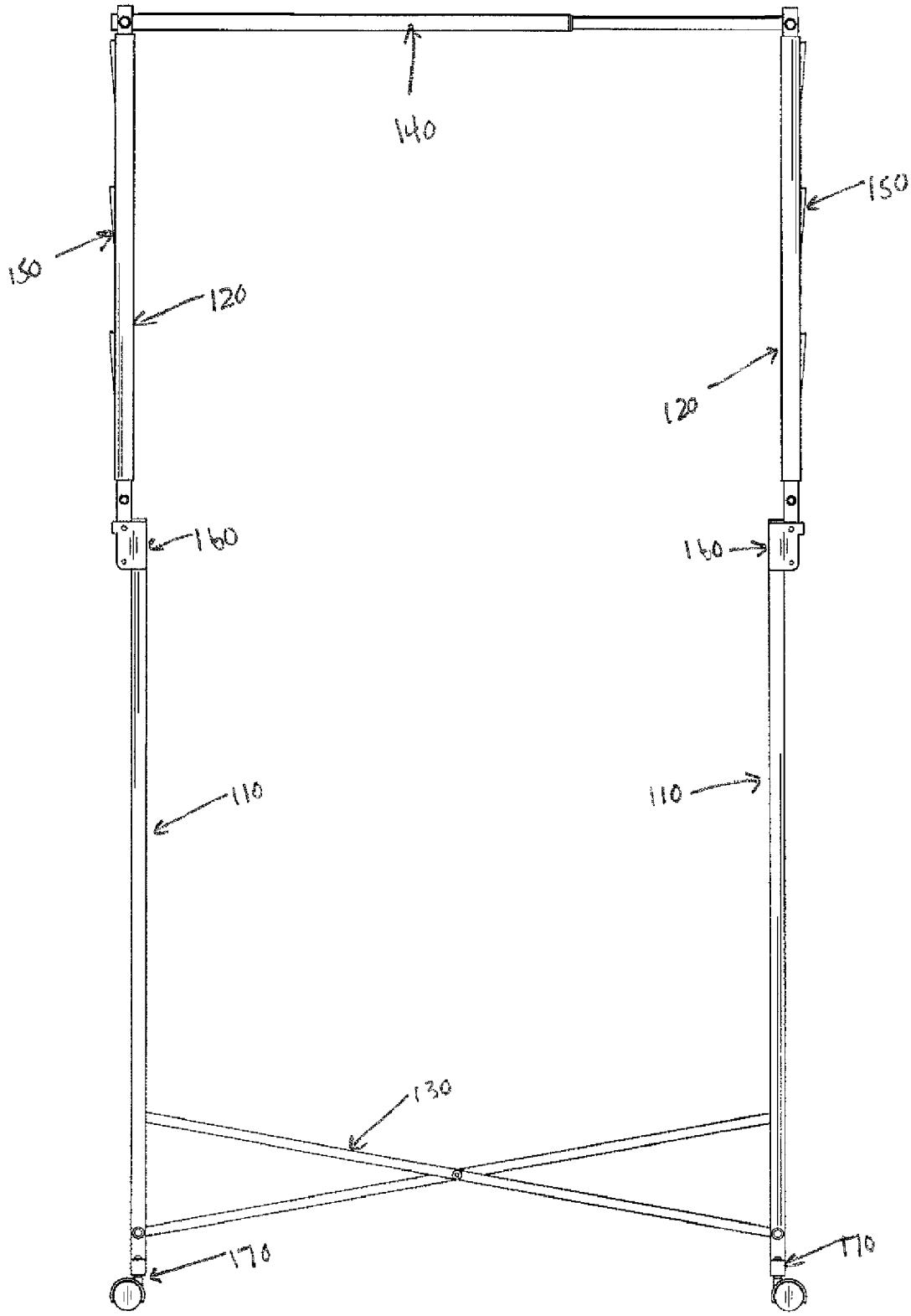
FIG. 2 is a front view of the folding collapsible clothes rack from FIG. 1.
Figure 3:
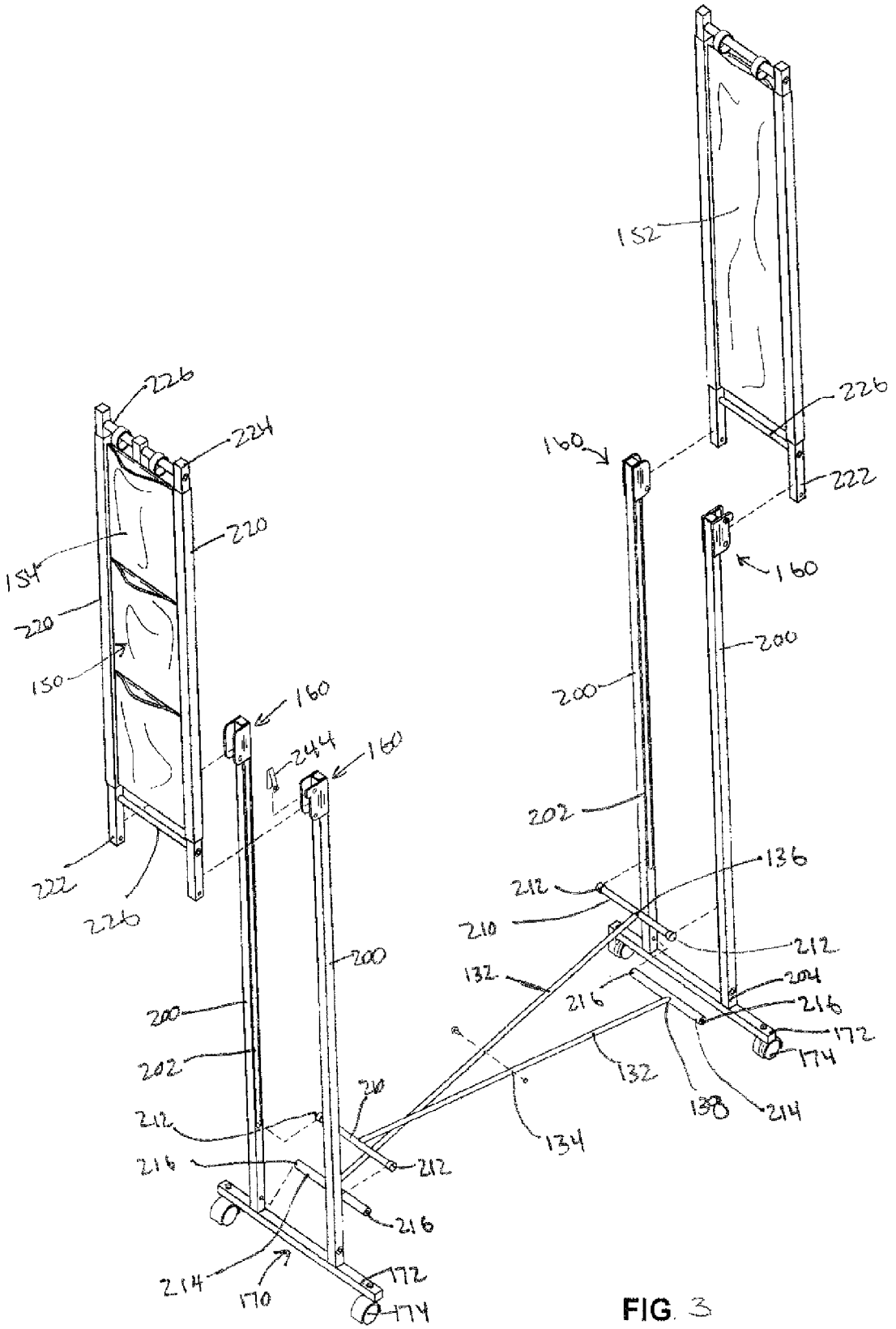
FIG. 3 is a perspective view of the folding collapsible clothes rack from FIG. 1 illustrating the partial removal of the two retractable side frames.
Figure 4:
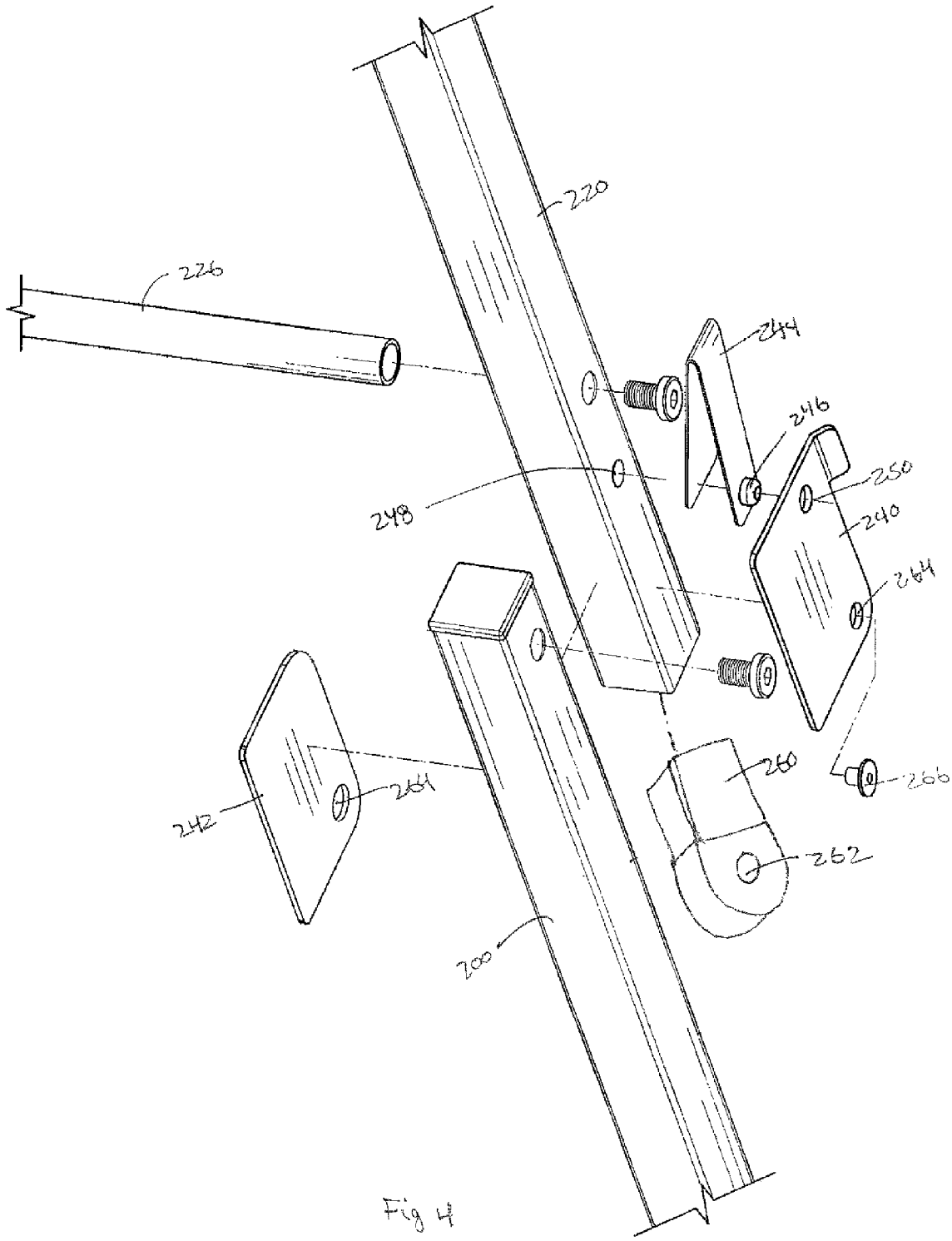
FIG. 4 is an exploded close-up view of the pivotal connection junction used for connecting the retractable side frames to the fixed side frames.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the claims by the embodiments illustrated.

Referring to FIGS. 1 through 4, a folding collapsible clothes rack 100 in accordance with the present invention is shown comprised of two fixed side frames 110, two retractable side frames 120, collapsible reinforcing links 130, and a cross hanger tube 140. Positioned along the outside of the retractable side frames 120 are a plurality of pockets 150. Each one of the fixed side frames 110 is attached to one of the two retractable side frames 120 at a pivotal connection junction 160. Positioned separately along the bottom of the fixed side frames 110 are wheel frames 170.

Each of the two fixed side frames 110 is defined by having a pair of elongated slotted members 200 (also shown in FIG. 10) spaced apart a predetermined distanced. The slotted members 200 each include a slot or channel 202 along one side of the member. The member 200 are aligned such that the channels 202 are facing each other. In addition, the channels 202 preferably do not extend the entire height of the member towards the wheel frames 170. As further explained, below the channels 202 are aligned and positioned to accommodate the collapsible reinforcing links 130. The bottom ends 204 of the slotted members 200 are secured to the wheel frames 170, and more specifically, the bottom ends 204 are secured to a bottom wheel-member frame 172, which also accommodates or receives the bottom caster wheels 174.

Figure 6:
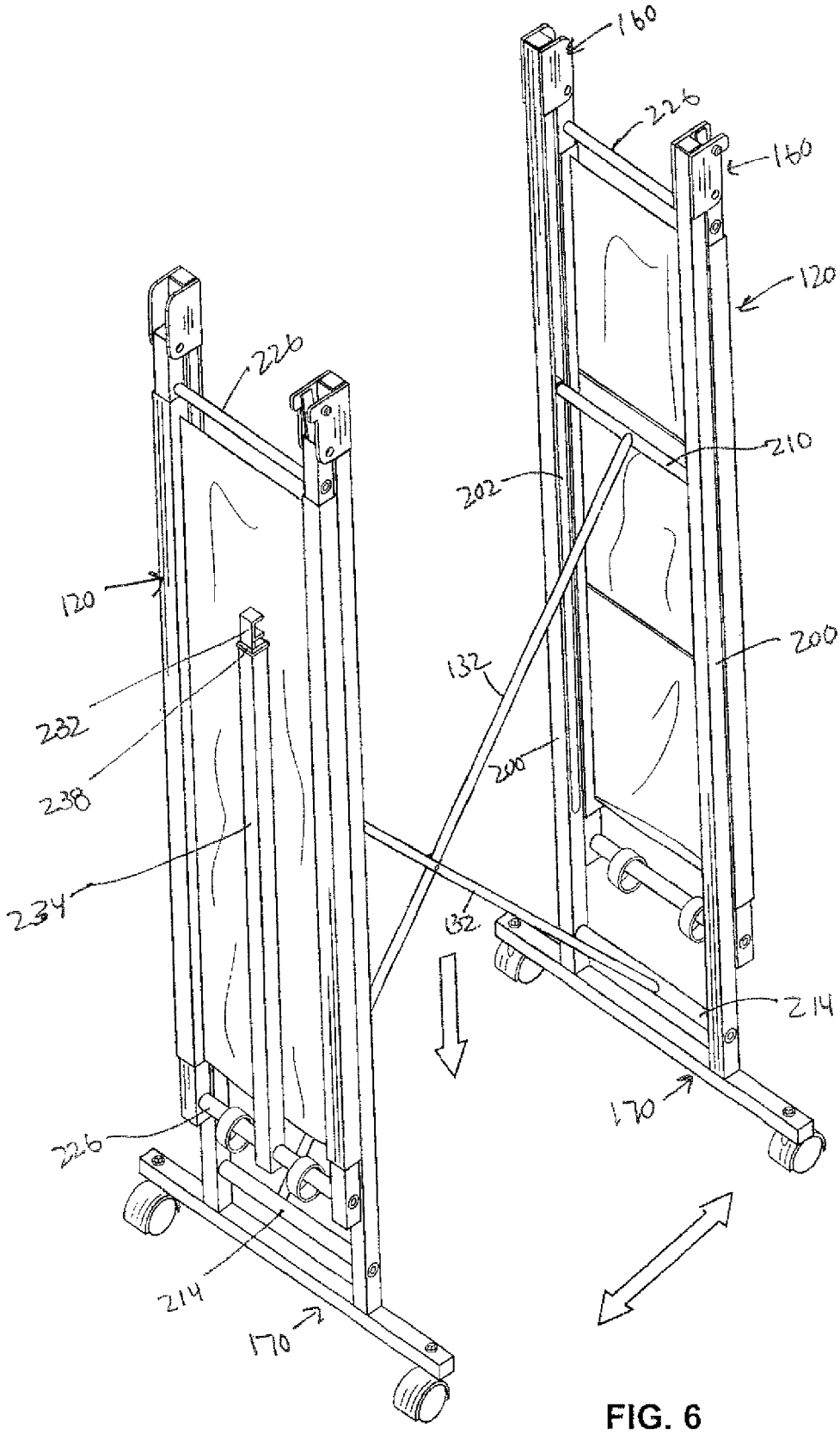
FIG. 6 is a perspective view of the folding collapsible clothes rack from FIG. 1 illustrating the two fixed side frames being moved away from each other.

The collapsible reinforcing links 130 is defined by having a pair of cross tubes 132 pivotally secured to each other about a mid-point junction 134. The cross tubes 132 have upper ends 136 and lower ends 138. The upper ends 136 are separately secured to an upper axle 210 positioned transverse to the slotted members 200. Positioned about the ends of the axle 210 are axle sockets 212 that is slidably engaged within the channel 202. The lower ends 138 are separately secured to a lower axle 214, which has ends 216 that are secured near the bottom ends 204 of the slotted members 200. As shown in FIG. 6, when collapsing the fixed side frames 110 towards each other, the collapsible reinforcing links 130 are forced to make a scissor action, having the upper ends 136 of the cross tubes 132 slide along the channel 202 towards the top portion of the fixed side frames 110 while the lower ends 138 of the cross tubes 132 stay fixed to the bottom portion of the fixed side frames 110. When fully extended, the reinforcing links 130 act to help stabilize the sides and keep them aligned with each other.

As mentioned above the two fixed side frames 110 are separately attached to the two retractable side frames 120 at the pivotal connection junction 160. The two retractable side frames 120 are separately composed of a pair of retracting members 220. The retracting members 220 include a lower region 222 about which is secured to the pivotal connection junction 160 and an upper region 224. For stability, each pair of retracting members 220 includes cross spanning bars 226 positioned adjacent the lower regions 222 and about the upper regions 224.

The cross hanger tube 140 is rotatably secured at one end 230 to one of the cross spanning bars 226 positioned adjacent the upper region 224 of a pair of retracting member 220, while its other end 232 is removably secured to the opposing cross spanning bar 226. The removably connection may be a hook positioned at the end 232. The cross hanger tube 140 is preferably designed to allow it to extend and retract in length. This is accomplished by having a first hanger tube 234 with a slightly larger diameter than a second hanger tube 236. The second hanger tube 236 is able to slide within the first hanger tube 234 allowing it to retract and extend. A sleeve and collar attachment 238 is positioned at the end of the first hanger tube 234 to allow the second hanger tube 236 to slide frictionally such that the sleeve and collar attachment 238 provides a slight resistance to having the enter second hanger tube 236 removed.

The pivotal connection junction 160 is also an important component because it permits the two retractable side frames 120 to retract and fold onto the two fixed side frames 110. The pivotal connection junction 160 as shown in the exploded view of FIG. 4. The upper portion 201 of the slotted member 200 is pivotally connected to the lower region 222 of the retracting member 220. The pivotal connection junction 160 is defined by having a button hinge plate 240 positioned on the outside of the slotted and retracting members and a hinge plate 242 on the inside of the slotted and retracting members. A spring pin 244 having a V shape with a button 246 extending outwardly from one side is positioned within the retracting member 220 and aligned such that the button 246 is extending out of an opening 248. The button 246 will further extend out of an aperture 250 on the button hinge plate 240. Positioned through the lower region 222 of the retracting member 220 is a hinge 260. The hinge 260 includes an opening 262 to receive a hinge rivet 266 through aligned openings 264 on the button hinge plate and on the hinge plate 242. Upon assembly, the button 246 on the spring pin 244 is depressed through the button hinge plate 240 allowing the retracting member 220 to pivot about the hinge rivet 266.

The pockets 150 are typically made up of a single backing material 152 with a plurality of folded material sections 154 around the front. Having stitching along three edges of the folded material sections 154 permits the formation of the pockets.

Figure 5:
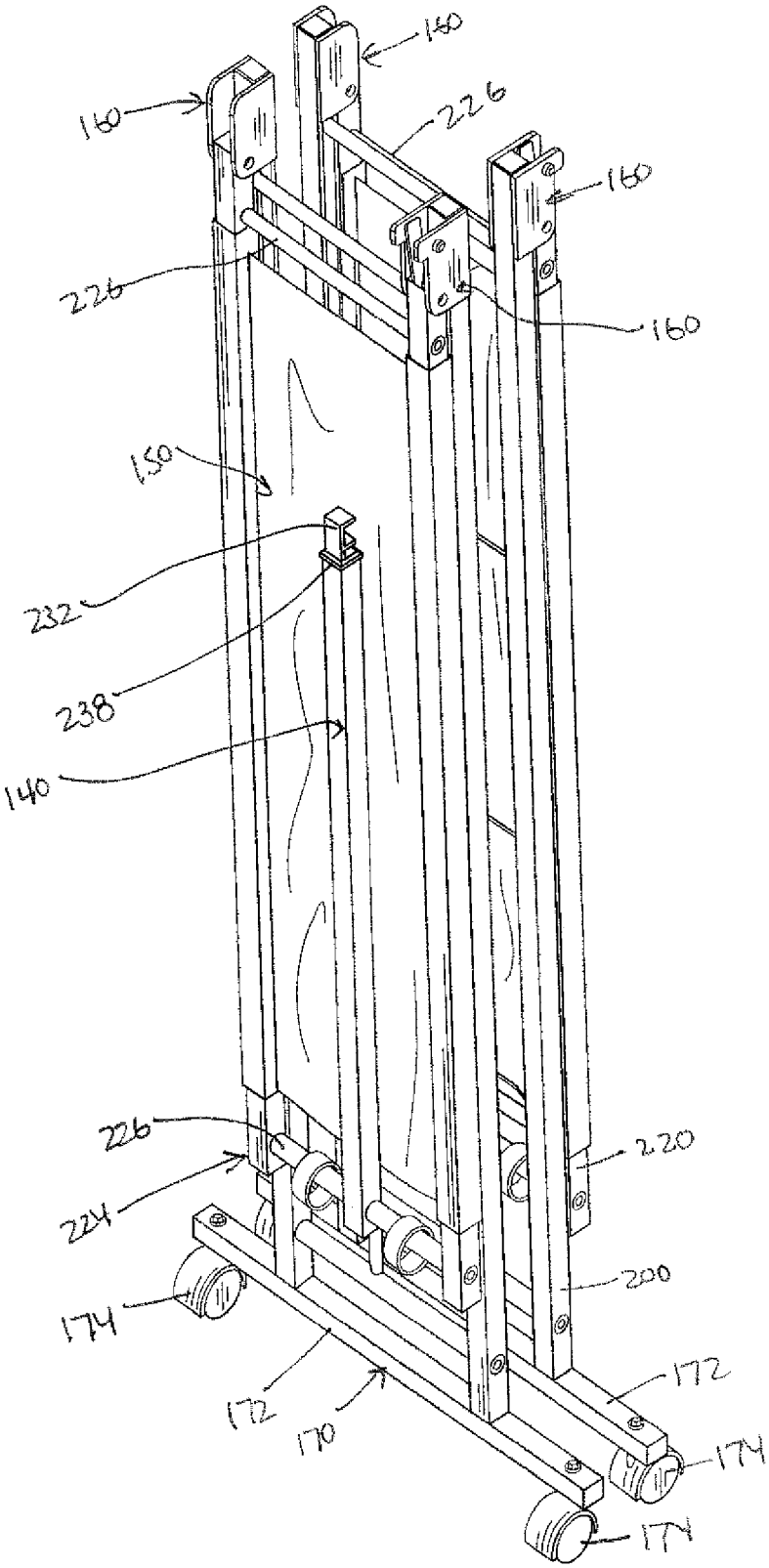
FIG. 5 is a perspective view of the folding collapsible clothes rack from FIG. 1 shown in a collapsed position.
Figure 7:
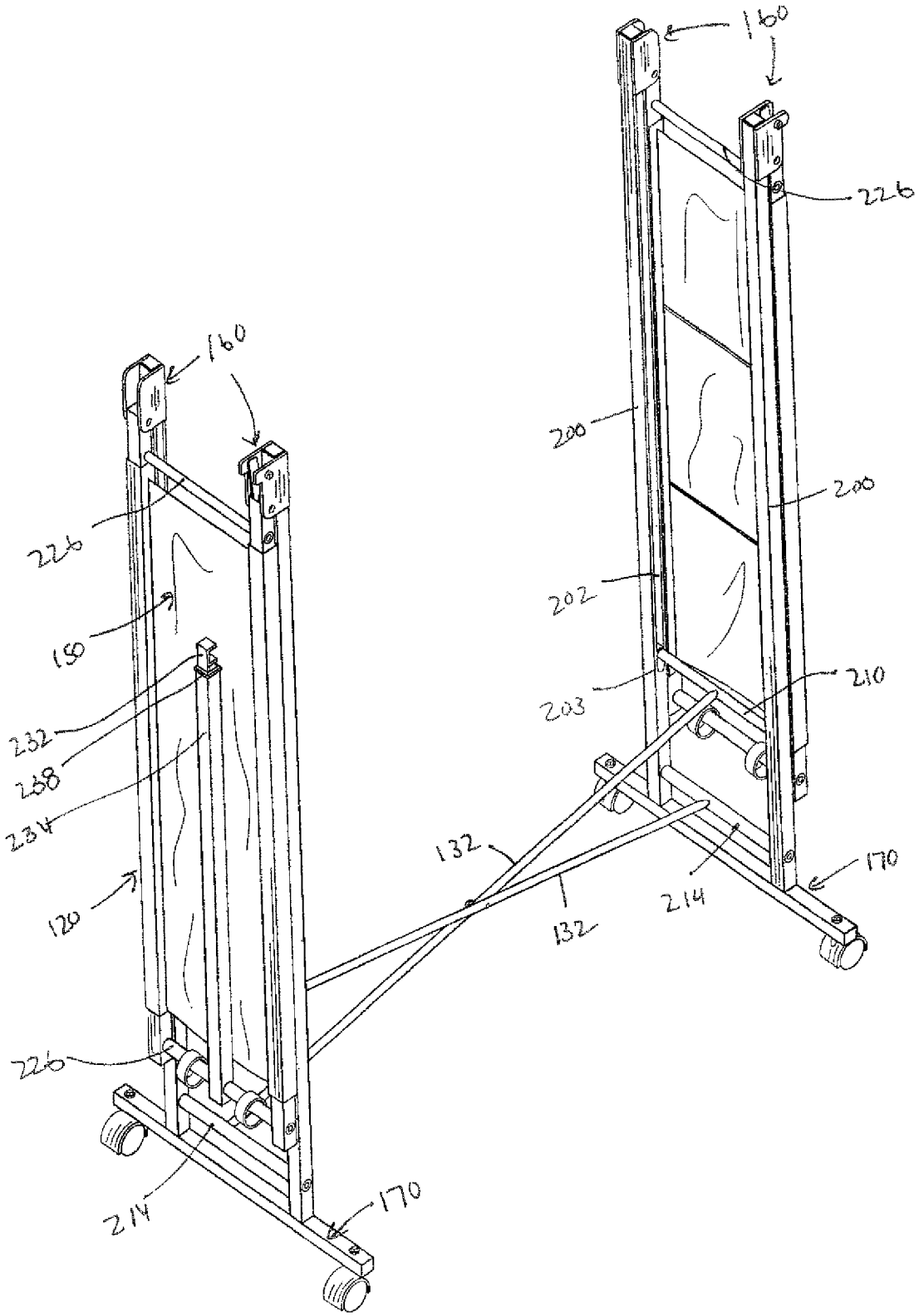
FIG. 7 is a perspective view of the folding collapsible clothes rack from FIG. 1 illustrating the two fixed side frames being fully extended away from each other.
Figure 8:
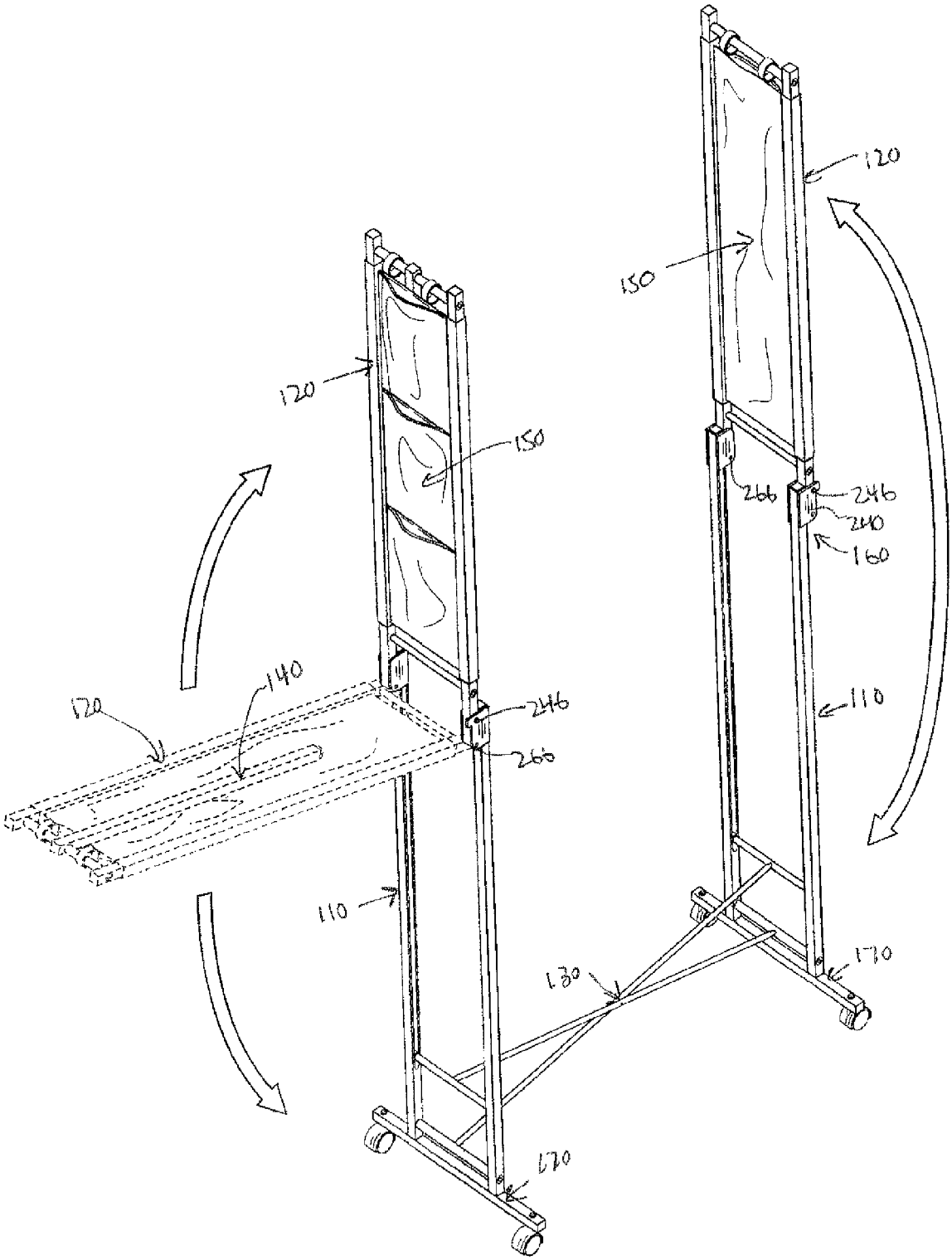
FIG. 8 is a perspective view of the folding collapsible clothes rack from FIG. 1 illustrating the two retractable side frames being extending upwardly.
Figure 9:
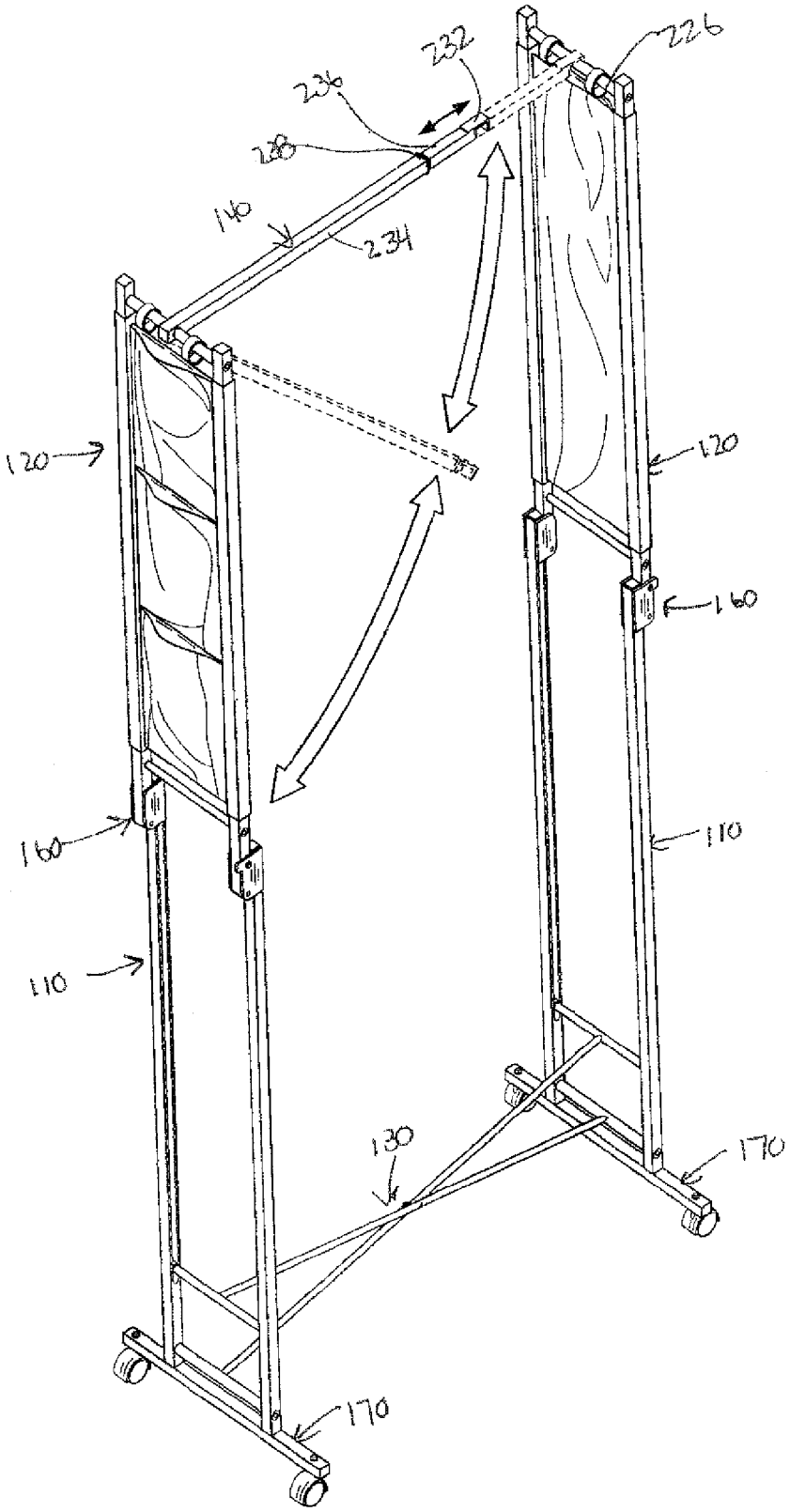
FIG. 9 is a perspective view of the folding collapsible clothes rack from FIG. 1 illustrating the top cross bar being extending to connect the two side frames together.

Turning now to FIGS. 5 through 9, the evolution of the expansion of the folding collapsible clothes rack 100 is shown. First, the rack 100 is shown in its complete collapsible and folded position (FIG. 5). In FIG. 6, the rack 100 is beginning its expansion with the two fixed side members 110 being retracted away from each other causing the reinforcing links 130 to slide into place. Initially the upper axles 210 are positioned towards the upper regions of the slotted members 200. However, as the two fixed side frames 110 are pulled apart, the upper axles 210 slide downwardly. In FIG. 7 the two fixed side frames 110 are in position and the collapsible reinforcing links 130 having moved into a final position defined by the upper axles 210 resting in the channel 202 about the end 203 of the channel 202. FIG. 8 illustrates the folding of the retractable side frames 120 about the hinge rivet 266. When in position, the button 246 of the spring pin 244 will align and click or insert into the aperture 250 on the button hinge plate 240. Lastly, in FIG. 9, the cross hanger tube 140 is extended and hooked onto the opposite cross member 226.

Figure 10:
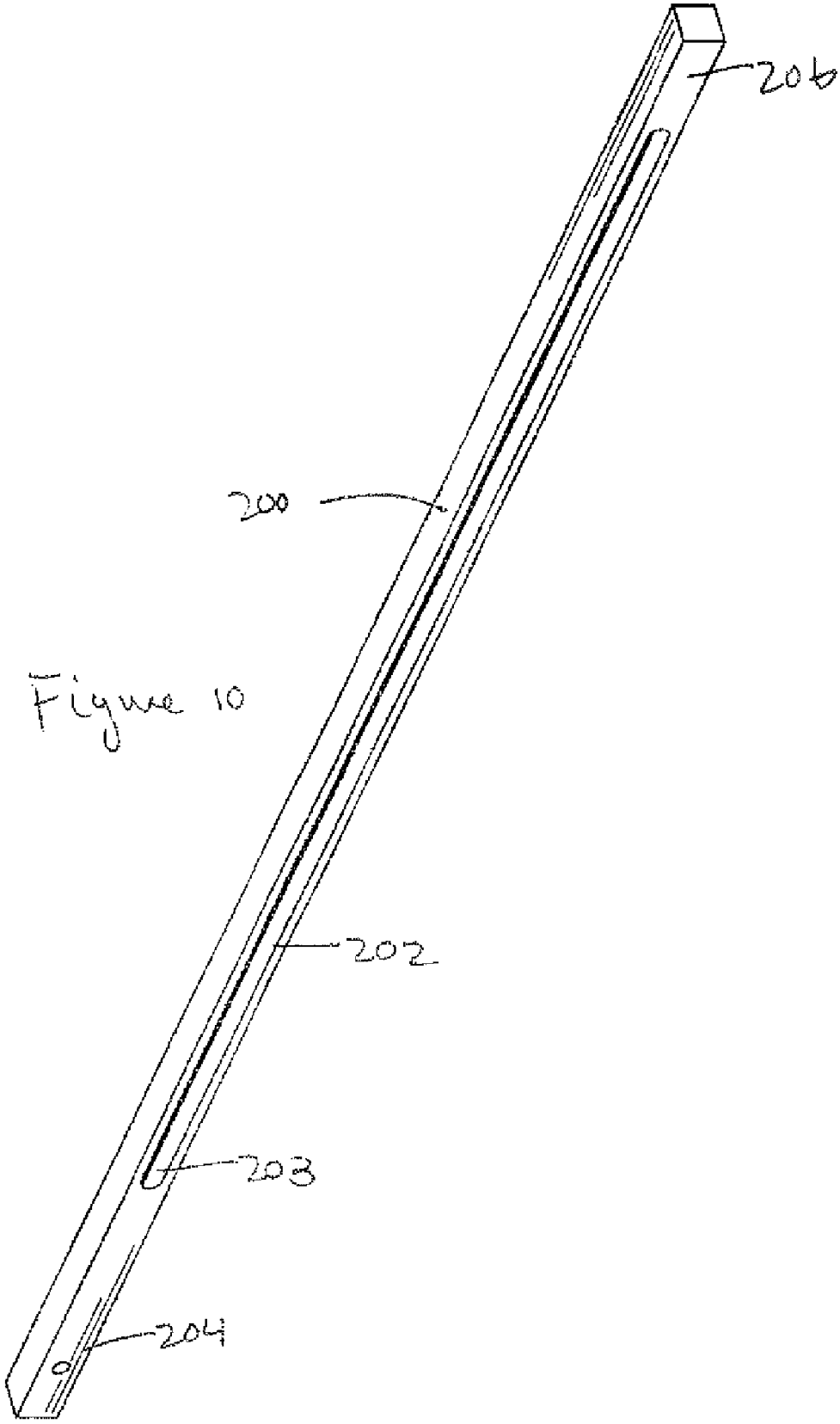
FIG. 10 is a perspective view of a fixed side frame elongated slotted member.
Figure 11:
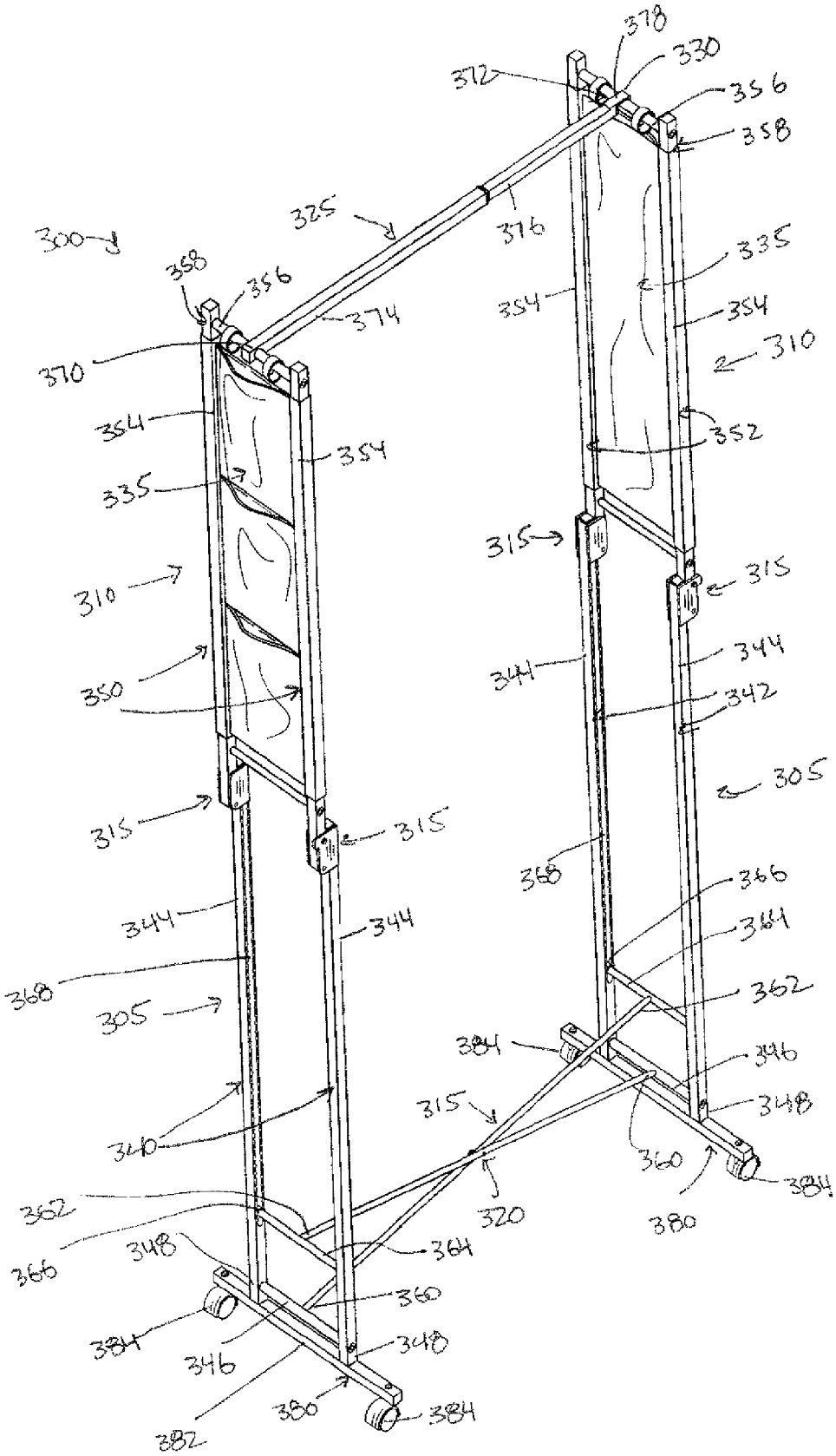
FIG. 11 is a perspective view of a folding collapsible clothes rack in accordance to a second embodiment of the invention and shown in an unfolded position.
Figure 12:
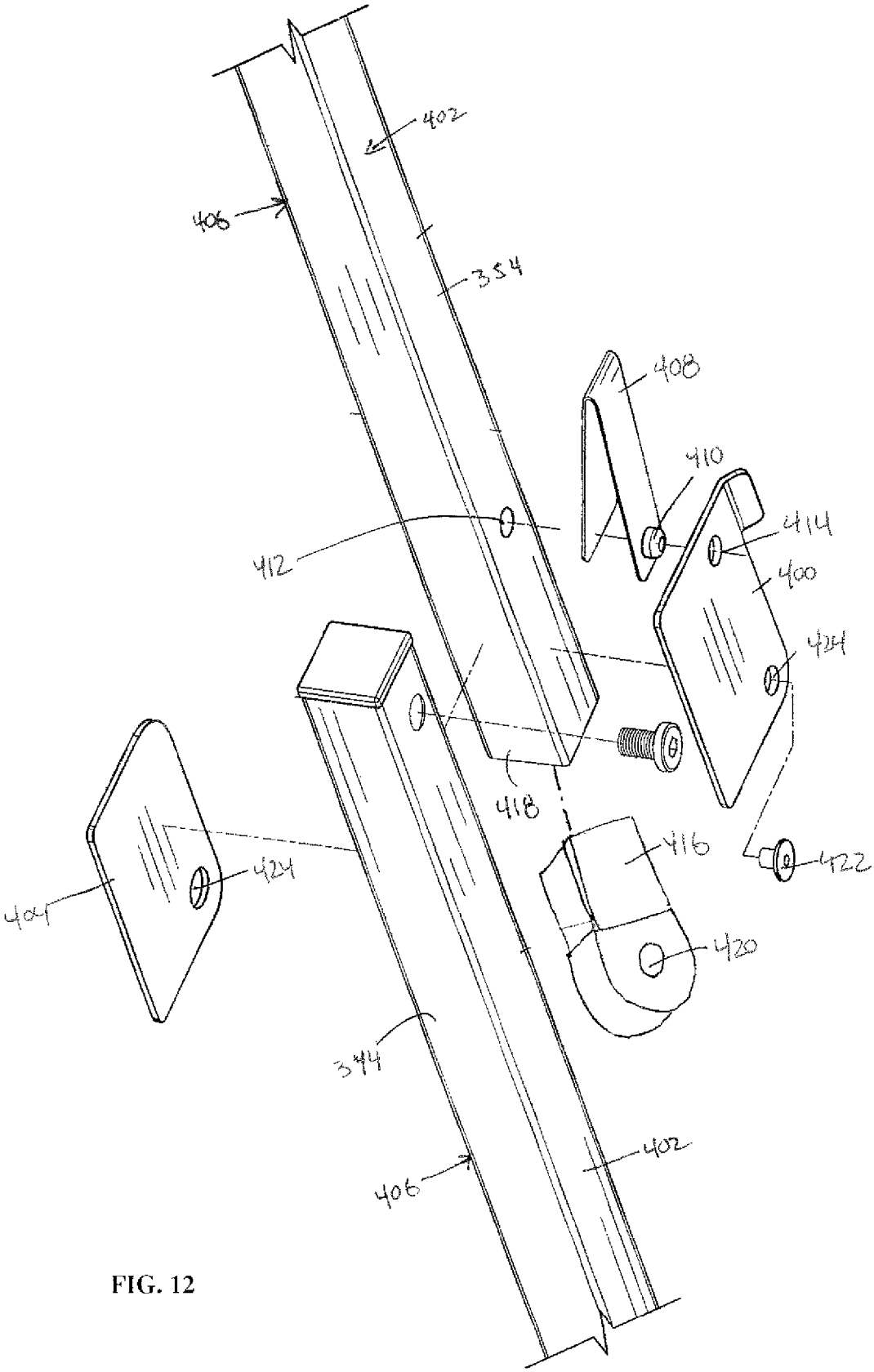
FIG. 12 is an exploded close-up view of the pivotal connection junction used for connecting the retractable side frames to the fixed side frames.

Referring now to FIGS. 10 and 11, in another embodiment of the present invention, there is provided a folding collapsible clothes rack 300. The rack 300 includes two fixed side frames 305 and two retractable side frames 310 pivotally connected 315 separately to the two fixed side frames 305. A pair of reinforcing links 315 are pivoted together 320 and coupled between the fixed side frames 305. In addition, a cross hanger tube 325 is secured between the two retractable side frames 310 and is able to be removably attached 330 from one of them. The rack 300 may also include a plurality of pockets 335 positioned about the retractable side frames 310.

As further defined by an embodiment of the invention, the fixed side frames 305 may be defined by having a first fixed side frame 340 and a second fixed side frame 342. Each of the side frames 340 and 342 comprise two upright parallel slotted members 344 and have a first lower member cross bar 346 transversely connected between a lower region 348 defined by the two upright parallel slotted members 344. The retractable side frames 310 may be defined by having a first retractable side frame 350 and a second retractable side frame 352. Each of the retractable side frames 350 and 352 comprise two upright parallel retracting members 354 and have an upper member cross bar 356 transversely connected between an upper region 358 defined by the two upright parallel retracting members 354.

The pivotal connection junctions 315 would preferably be connecting each upright parallel slotted member 344 to an upright parallel retracting member 354 such that each one of the retractable side frames 310 is pivotally connected to one of the fixed side frame 305.

The two reinforcing links 315 are pivoted together 320 and coupled between the fixed side frames 305. The links 315 each have a lower end 360 coupled to the first lower member cross bar 346 and have an upper end 362 coupled to a second lower member cross bar 364 transversely positioned between the two upright parallel slotted members 344. The second lower member cross bar 364 has ends 366 slideably engaged within slots 368 defined along the two upright parallel slotted members 344.

The cross hanger tube 325 has one end 370 secured to one of the upper member cross bar 356 and has another end 372 removably secured 330 to the other upper member cross bar 356. In a further embodiment, the cross hanger tube 325 is further defined by having a first hanger tube 374 having a diameter sized to receive a second hanger tube 376, such that the second hanger tube 376 is able to expand from and retract within the first hanger tube 374. The end 372 of the second hanger tube 376 is further provided with a hook 378 to removably secure the end to the other upper member cross bar 356.

In another embodiment, the rack includes wheel frames 380 secured to lower regions 348 defined by the two fixed side frames 305. The wheel frames 380 are further defined by having a bottom wheel-member frame 382 transversely secured about the lower region 348 defined by the two upright parallel slotted members 344 and each bottom wheel-member frame 382 further includes a pair of caster wheels 384.

In yet another embodiment, each pivotal connection junction 315 is defined to include a button hinge plate 400 positioned on an outside 402 of the slotted and retracting members 354 and 344 and a hinge plate 404 positioned on an inside 406 of the slotted and retracting members. A spring pin 408 having a button 410 extending outwardly from one side of the spring pin 408 is positioned within the retracting member 354 and aligned such that the button 410 is extending out of an opening 412 and further extending out of an aperture 414 defined on the button hinge plate 400. A hinge member 416 extends from a lower region 418 of the retracting member 354 and includes a hinge opening 420 sized to receive a hinge rivet 422 which extends through aligned openings 424 on both the button hinge plate 400 and on the hinge plate 404. Therefore, when depressing the button 410 through the button hinge plate 400, the retracting member is able to pivot about the hinge rivet 422.

By utilizing the above configuration, a collapsible folding clothes rack can be economically provided to end users by providing it to them in a partially assembled configuration. In view of the above, it will be seen that several advantages of the present invention have been achieved and other advantageous results have been obtained. From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. A folding collapsible clothes rack comprising:

two fixed side frames, said fixed side frames defining a first fixed side frame and a second fixed side frame each comprising two upright parallel slotted members and having a first lower member cross bar transversely connected between a lower region defined by the two upright parallel slotted members;

two retractable side frames, said retractable side frames defining a first retractable side frame and a second retractable side frame each comprising two upright parallel retracting members and having an upper member cross bar transversely connected between an upper region defined by the two upright parallel retracting members;

pivotal connection junctions connecting each upright parallel slotted member to a upright parallel retracting member such that each one of the said retractable side frames are pivotally connected to one of the said fixed side frame;

two reinforcing links pivoted together and coupled between said fixed side frames, said links each having a lower end coupled to the first lower member cross bar and having an upper end coupled to a second lower member cross bar transversely positioned between the two upright parallel slotted members and the second lower member cross bar having ends slideably engaged within slots defined along the two upright parallel slotted members; and a cross hanger tube having one end secured to one of the upper member cross bar and having another end removably secured to the other upper member cross bar.

2. The folding collapsible clothes rack of claim 1 further comprising:

a plurality of pockets positioned between two upright parallel retracting members.

3. The folding collapsible clothes rack of claim 1 further comprising:

wheel frames secured to lower regions defined by the two fixed side frames, wherein the wheel frames are further defined by having a bottom wheel-member frame transversely secured about the lower region defined by the two upright parallel slotted members and each bottom wheel-member frame further includes a pair of caster wheels.

4. The folding collapsible clothes rack of claim 1, wherein the cross hanger tube is further defined by having a first hanger tube having a diameter sized to receive a second hanger tube, such that the second hanger tube is able to expand from and retract within the first hanger tube, the end of the second hanger tube is further provided with a hook to removably secure the end to said other upper member cross bar.

5. The folding collapsible clothes rack of claim 1, wherein each pivotal connection junction is defined to include:

a button hinge plate positioned on an outside of the slotted and retracting members and a hinge plate positioned on an inside of the slotted and retracting members, a spring pin having a button extending outwardly from one side of the spring pin is positioned within the retracting member and aligned such that the button is extending out of an opening and further extending out of an aperture defined on the button hinge plate, and a hinge member extends from a lower region of the retracting member and includes a hinge opening sized to receive a hinge rivet which extends through aligned openings on both the button hinge plate and on the hinge plate, whereby, depressing the button through the button hinge plate allows the retracting member to pivot about the hinge rivet.

6. A folding collapsible clothes rack comprising:

two fixed side frames, said fixed side frames defining a first fixed side frame and a second fixed side frame each comprising two upright parallel slotted members and having a first lower member cross bar transversely connected between a lower region defined by the two upright parallel slotted members;

two retractable side frames, said retractable side frames defining a first retractable side frame and a second retractable side frame each comprising two upright parallel retracting members and having an upper member cross bar transversely connected between an upper region defined by the two upright parallel retracting members;

pivotal connection junctions connecting each upright parallel slotted member to a upright parallel retracting member such that each one of the said retractable side frames are pivotally connected to one of the said fixed side frame; and two reinforcing links pivoted together and coupled between said fixed side frames, said links each having a lower end coupled to the first lower member cross bar and having an upper end coupled to a second lower member cross bar transversely positioned between the two upright parallel slotted members and the second lower member cross bar having ends slideably engaged within slots defined along the two upright parallel slotted members.

7. The folding collapsible clothes rack of claim 6, wherein each pivotal connection junction is defined to include:

a button hinge plate positioned on an outside of the slotted and retracting members and a hinge plate positioned on an inside of the slotted and retracting members, a spring pin having a button extending outwardly from one side of the spring pin is positioned within the retracting member and aligned such that the button is extending out of an opening and further extending out of an aperture defined on the button hinge plate, and a hinge member extends from a lower region of the retracting member and includes a hinge opening sized to receive a hinge rivet which extends through aligned openings on both the button hinge plate and on the hinge plate, whereby, depressing the button through the button hinge plate allows the retracting member to pivot about the hinge rivet.

8. The folding collapsible clothes rack of claim 7 further comprising a cross hanger tube having one end secured to one of the upper member cross bar and having another end removably secured to the other upper member cross bar and wherein the cross hanger tube is further defined by having a first hanger tube having a diameter sized to receive a second hanger tube, such that the second hanger tube is able to expand from and retract within the first hanger tube, the end of the second hanger tube is further provided with a hook to removably secure the end to said other upper member cross bar.

9. The folding collapsible clothes rack of claim 6 further comprising:

a plurality of pockets positioned between two upright parallel retracting members.

10. The folding collapsible clothes rack of claim 6 further comprising:

wheel frames secured to lower regions defined by the two fixed side frames, wherein the wheel frames are further defined by having a bottom wheel-member frame transversely secured about the lower region defined by the two upright parallel slotted members and each bottom wheel-member frame further includes a pair of caster wheels.

* * * * *